US005979116A

United States Patent [19]

Myoga

[11] Patent Number: 5,979,116

[45] Date of Patent: Nov. 9, 1999

[54] FLOOR APPARATUS

[75] Inventor: Takeshi Myoga, Osaka, Japan

[73] Assignee: Hitachi Zosen Corporation, Osaka, Japan

[21] Appl. No.: 09/011,054

[22] PCT Filed: Jun. 2, 1997

[86] PCT No.: PCT/JP97/01876

§ 371 Date: May 4, 1998

§ 102(e) Date: May 4, 1998

[87] PCT Pub. No.: WO97/46777

PCT Pub. Date: Dec. 11, 1997

[30] Foreign Application Priority Data

Jun. 6, 1996 [JP] Japan ..... 8-143785

[51] Int. Cl.[6] ..... E04H 3/12

[52] U.S. Cl. ..... 52/8; 52/6; 52/64; 52/126.5

[58] Field of Search ..... 52/64, 263, 6, 52/126.5, 126.6, 8; 472/75, 71

[56] References Cited

U.S. PATENT DOCUMENTS

| | | | |
|---|---|---|---|
| 1,868,068 | 7/1932 | Moulton | 52/64 |
| 2,587,159 | 2/1952 | Holmes | 52/64 |
| 4,885,878 | 12/1989 | Wuu | 52/6 |
| 5,365,704 | 11/1994 | Ray | 52/64 |
| 5,660,000 | 8/1997 | MacIntyre | 52/6 |
| 5,890,323 | 4/1999 | Errato | 52/6 |

FOREIGN PATENT DOCUMENTS

| | | | |
|---|---|---|---|
| 271402 | 6/1988 | United Kingdom | 52/64 |

*Primary Examiner*—Carl D. Friedman
*Assistant Examiner*—Dennis L. Dorsey
*Attorney, Agent, or Firm*—Reising, Ethington, Barnes, Kisselle, Learman & McCulloch, PC

[57] ABSTRACT

A floor apparatus (1) comprises a support base (8) and a passage base (10), each being rotatable about axes (11, 12) of rotation respectively, the support base (8) having a seat surface (13) mounted with seats (7) and a first selective surface (14), the passage base (10) having a passage surface (16) and a second selective surface (15), and a rotating device (5) for rotating the support base (8) and the passage base (10) about the axes (11, 12) of rotation respectively. The first selective surface (14) or the second selective surface (15) is selected and used depending upon events, thereby improving versatility of a floor surface in accordance with the events.

2 Claims, 4 Drawing Sheets

FLOOR APPARATUS

TECHNICAL FIELD

The present invention relates to a floor apparatus installed for example in a theater.

BACKGROUND ART

An example of floor apparatuses installed in theaters and the like is shown in FIG. 4. Such a floor apparatus 50 comprises a lift 53 liftably mounted on a base 51 via lifting jacks 52, and an audience gallery 55 provided above the lift 53 via a rotating device 54.

The audience gallery 55 comprises a plurality of support bases 61 having a seat surface 57 on which seats 56 are mounted on one selective surface thereof and a carpeted surface 60 to which carpet 58 is applied on the other selective surface thereof, and a passage base 63 (for example, a carpet is applied to the surface thereof) provided between the support bases 61.

Each of these support bases 61 is rotatably provided about the center axis of rotation 64.

The rotating device 54 comprises a rotating motor 65 installed on the lift 53, a plurality of driving pulleys 67 fixed to the output shaft 66 of the rotating motor 65, an inverted shaft 68 fixed to and spanned between both support bases 61 and provided along the center axis of rotation 64, and an inverted pulleys 71 linked with the driving pulleys 67 via transmission belts 70 and fixed to the inverted shaft 68.

In such a floor apparatus 50, the rotating motor 65 drives the driving pulleys 67, this drive force is transmitted through the transmission belts 70 to rotate the inverted pulleys 71, which in turn rotates the support bases 61 by 180° about the inverted shaft 68 (the center axis of rotation 64).

With the operation of the floor apparatus 50 described above, the use of either the seat surface 57 or the carpeted surface 60 is selected according to the events in theaters.

In the floor apparatus 50 described above, however, even if the floor surfaces may be selected by rotating the support bases 61, the versatility of the floor surfaces to the events is lowered because such a floor apparatus has no mechanisms to rotate the passage base 63.

It is an object of the present invention is to provide a floor apparatus which can solve the above problem.

DISCLOSURE OF THE INVENTION

According to the present invention, there is provided a floor apparatus comprising support bases on which seats are installed and a passage base arranged adjacent to the support bases, each being constituted to be rotatable about the axes of rotation; said support base having a seat surface on which the seats are installed and a first selective surface used according to events; said passage base having a passage surface corresponding to the seat surface of the support base and a second selective surface corresponding to the first selective surface of the support base; and a rotating device for rotating the support base and the passage base about the axes of rotation.

By driving the rotating device, either the first selective surface or the second selective surface can be selected and used according to the events, and the versatility of the floor surface according to the events is improved.

According to another aspect-of the present invention, there is provided a floor apparatus, in which the first selective surface is a surface arranged in the location opposing the seat surface; the support base is fixed to a shaft arranged along the axis of rotation; the second selective surface is a bent surface bent by an angle of 90° relative to the passage surface; the passage base is fixed on another support member arranged along the axis of rotation; a driving motor having an output shaft linked to the shaft of the support base and the shaft of the passage base via a linkage mechanism is provided in the rotating device; and the ratio of the rotation speed between the support base and the passage base in the linkage mechanism is set to be 2:1.

Therefore, the passage base is rotated by 90° when the support bases are rotated by 180° by the operation of the driving motor.

BEST MODE FOR CARRYING OUT THE INVENTION

Figure 1:
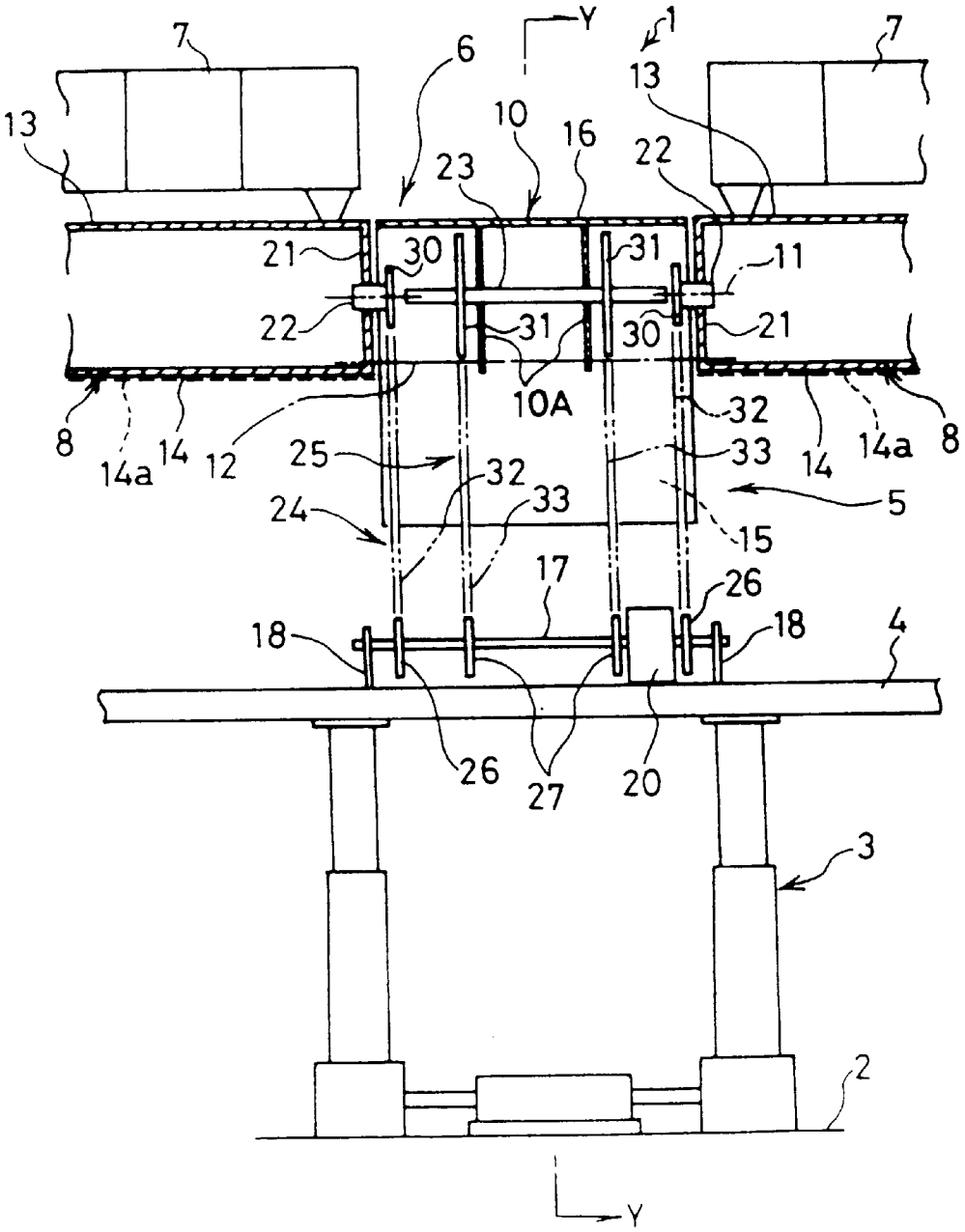
FIG. 1 is a front view showing the entire constitution of a floor apparatus according to the present invention.

The present invention will be described in detail with reference to attached drawings.

This floor apparatus 1 comprises a lift 4 liftably mounted on a base 2 via lifting jacks 3, and an audience gallery 6 provided above the lift 4 via a rotating device 5 described later.

The audience gallery 6 is provided with a plurality of box-shaped (having a rectangular cross-section) support bases 8 which support the seats 7, and a passage base 10 having an L-shaped cross-section arranged between these support bases 8. Each support base 8 and passage base 10 are constituted to be rotatable about different axes of rotation 11 and 12 respectively.

One side of each support base 8 is allocated to a seat surface 13 on which the seats 7 are installed, and the other side of each support base 8 opposing the seat surface 13 is allocated to a first selective surface 14 which is selected according to the event, and a carpet 14*a* is adhered onto the first selective surface 14.

Figure 2:
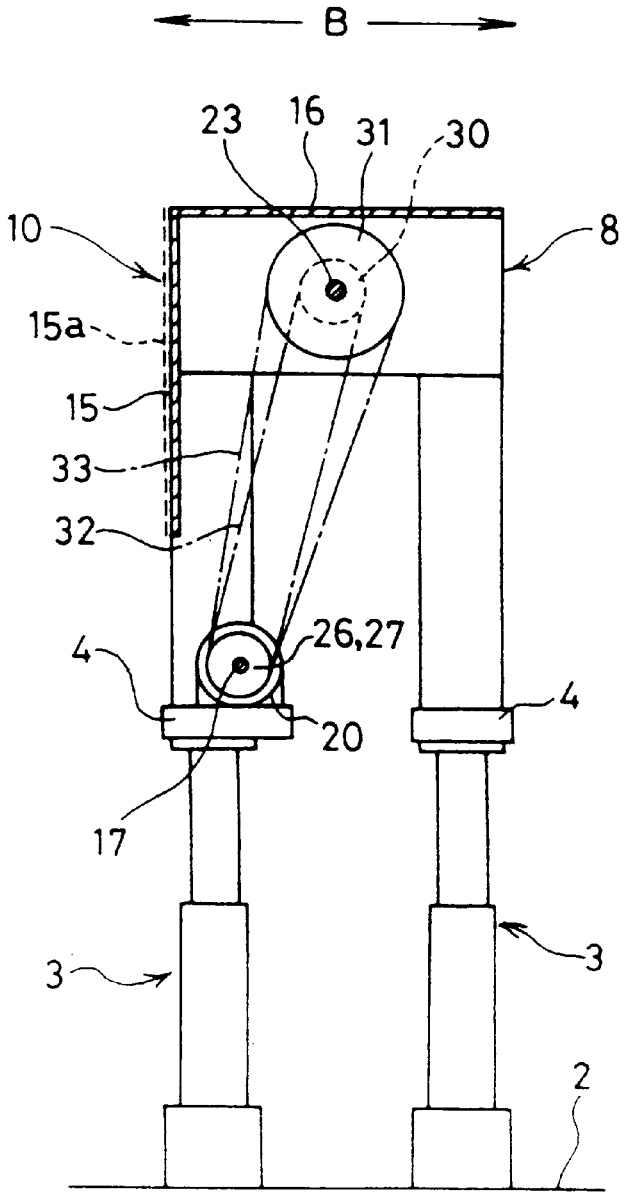
FIG. 2 is a sectional view taken in the direction of the arrows along the line Y—Y of FIG. 1.
Figure 3:
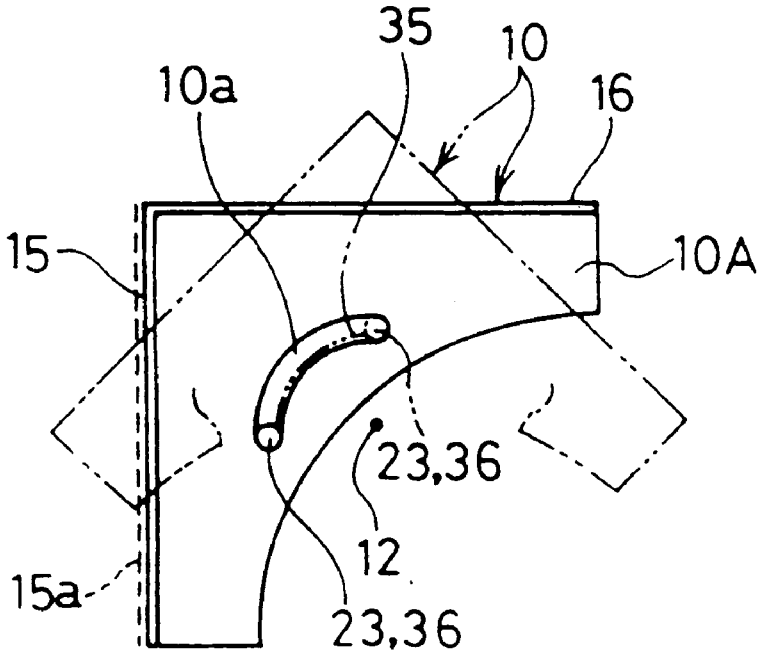
FIG. 3 is a side view illustrating the movement of a passage member.
Figure 4:
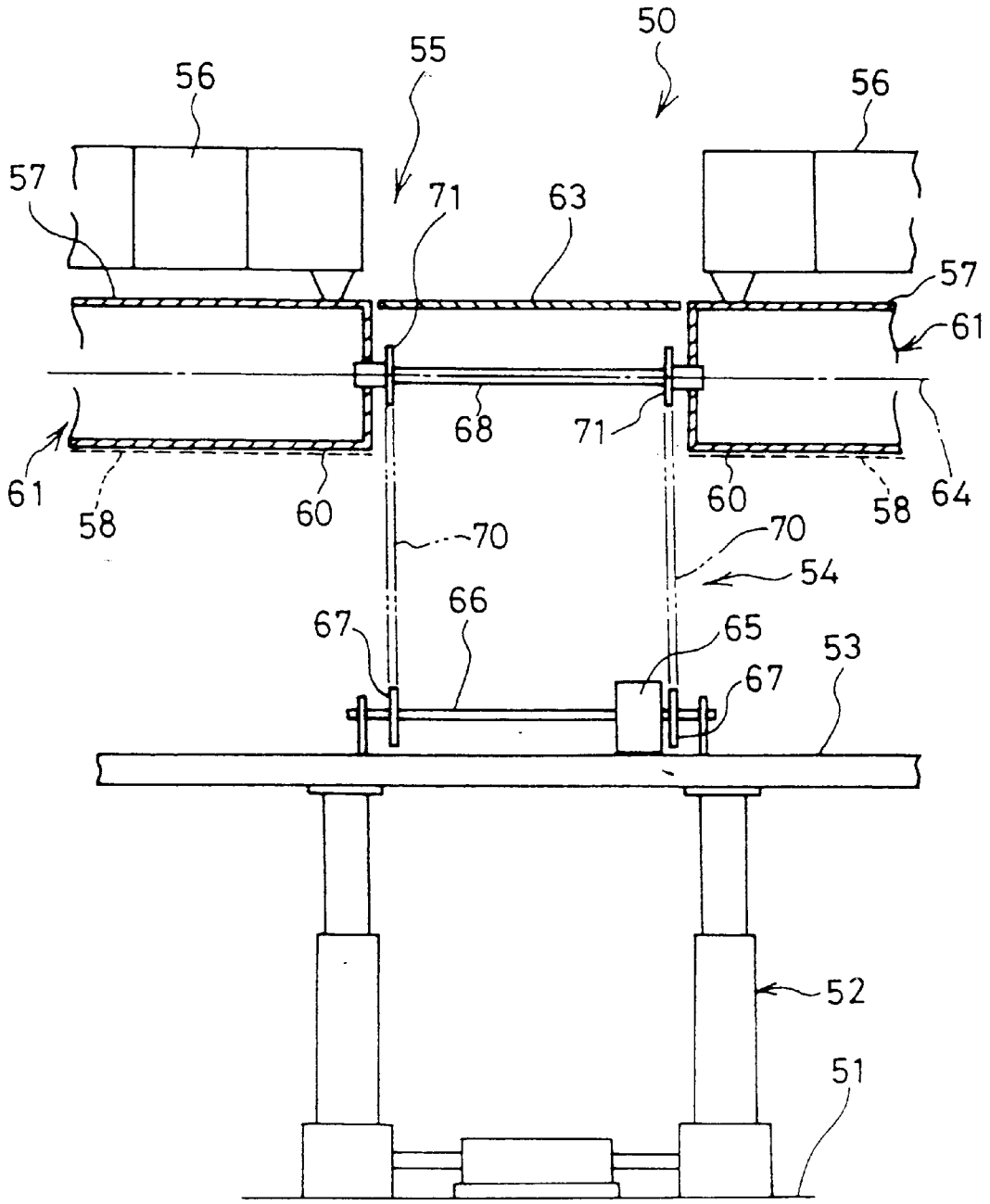
FIG. 4 Prior Art
FIG. 4 is a front view showing the entire constitution of a prior art floor apparatus.

As FIGS. 2 and 3 show, the passage base 10 comprises a passage surface 16 on one side corresponding to the seat surface 13 of each support base 8, and a second selective surface 15 on the other side bent by an angle of 90° relative to the passage surface 16 and corresponding to the first selective surface 14.

On the second selective surface 15, a carpet 15*a* is adhered. The width of the passage surface 16 is formed to be the same as the width of the second selective surface 15, and the width of the passage surface 16 is formed to be the same as the width of the seat surface 13.

The rotating device 5 is adapted to rotate the support base 8 and the passage base 10 about the axes of rotation 11 and 12, respectively.

This rotating device 5 comprises a rotating motor 20 of which output shaft 17 is installed on the lift 4 via bearings 18, a first linkage mechanism 24 which links the output shaft 17 with a first inverted shaft 22 inserted into the side walls 21 of the support bases 8, and a second linkage mechanism 25 which links the output shaft 17 with a second inverted shaft 23 inserted in guide slots 10*a* formed in ribs 10A of the passage bases 10.

The first inverted shaft 22 is coaxial with the second inverted shaft 23, and is placed separately from the second inverted shaft 23 in the axial direction.

The first linkage mechanism 24 comprises driving pulleys 26 fixed to the ends of the output shaft 17, inverted pulleys 30 fixed to the first inverted shaft 22, and transmission belts 32 which link the driving pulleys 26 with the inverted pulleys 30.

In the first linkage mechanism 24, the driving pulleys 26 are formed to have the same diameter with the inverted pulleys 30.

The second linkage mechanism 25 comprises driving pulleys 27 fixed to the middle portions of the output shaft 17, inverted pulleys 31 fixed to the second inverted shaft 23, and transmission belts 33 which link the driving pulleys 27 with the inverted pulleys 31.

The diameter of the driving pulleys 27 is the same as the diameter of the driving pulleys 26 in the first linkage mechanism 24, and the ratio of the diameter of the driving pulleys 27 to the diameter of the inverted pulley 31 in the second linkage mechanism 25 is set to be 1:2.

As FIG. 3 shows, the guide slot 10*a* is formed to have an arcuate shape having its center at the center of the axis of rotation 12. Teeth 35 are formed on one guide surface (e.g. the inner diameter side) of each guide slot 10*a,* and sprockets 36 which engage the teeth 35 are fixed to the middle portions of the second inverted shaft 23.

A plurality of such floor apparatuses 1 may be placed in the width direction B of a hall depending on the size of the hall.

When seats 7 are used in the floor apparatus 1, the seat surfaces 13 of the support bases 8 are positioned to face upward.

In the case of events which need the carpet 14*a* on the support bases 8 and the carpet 15*a* on the passage base 10, the support bases 8 and the passage base 10 are rotated from the state where the seat surfaces 13 of the support bases 8 are positioned to face upward to the state where the first selective surfaces 14 and the second selective surfaces 15 are positioned to face upward.

Since a plurality of the floor apparatuses are placed in the width direction B, when the support bases 8 and the passage base 10 are rotated, it is necessary that the adjacent support bases 8 and the adjacent passage bases 10 do not interfere with each other.

In order to avoid such interference, when the first selective surfaces 14 and the second selective surfaces 15 are to be used, the lifting jacks 3 of the floor apparatus 1 having the support bases 8 and the passage base 10 to be rotated are first operated to raise the lift 4 relative to the lifts 4 of other floor apparatuses 1, and then the support bases 8 and the passage base 10 are rotated.

When the support bases 8 and the passage base 10 are to be rotated, the rotating motor 20 is operated to transmit the drive force of the rotating motor 20 to the first inverted shaft 22 via the first linkage mechanism 24, and to the passage base 10 via the second linkage mechanism 25, thus causing the support bases 8 to rotate about the axis of rotation 11 and the passage base 10 to rotate about the axis of rotation 12.

In the first linkage mechanism 24, since the diameter of the driving pulleys 26 is the same as the diameter of the inverted pulleys 30, the 180° rotation of the driving pulleys 26 results in the 180° rotation of the inverted pulleys 30, whereby the support bases 8 is rotated (inverted).

Now, the operation of the passage base 10 will be described in detail. When the rotating motor 20 is operated to rotate the output shaft 17, the second inverted shaft 23 is rotated via the second linkage mechanism 25, and the rotation of the second inverted shaft 23 causes the rotation of the sprockets 36, which in turn causes the rotation of the passage base 10 about the axis of rotation 12, because the sprockets 36 are engaging the teeth 35.

At this time, since the ratio of the diameter of the driving pulleys 27 to the diameter of the inverted pulley 31 in the second linkage mechanism 25 is set to be 1:2, the inverted pulleys 31 rotate by 90° when the driving pulleys 27 rotate by 180°.

Therefore, the passage base 10 is rotated by 90° when the support bases 8 are rotated by 180° by the operation of the rotating motor 20.

Since the width of the passage surface 16 is equal to the width of the second selective surface 15, the width of the passage surface 16 is equal to the width of the seat surface 13, and the guide slot 10*a* is formed to have an arcuate shape having its center at the axis of rotation 12, when the support bases 8 rotate by 180° and the passage base 10 rotates by 90°, the height of the second selective surface 15 becomes equal to the height of the first selective surface 14 such that both the surfaces are brought to the same level.

As described above, the floor apparatus 1 of the present invention comprises support bases 8 and a passage base 10, each being rotatable about axes 11 and 12 of rotation, the support bases 8 having seat surfaces 13 mounted with seats 7 and a first selective surface 14, the passage base 10 having a passage surface 16 and a second selective surface 15, and a rotating device 5 for rotating the support bases 8 and the passage base 10 about the axes 11 and 12 of rotation.

Therefore, by driving the rotating device 5, the first selective surface 14 and the second selective surface 15 can be selectively used depending upon events, thus improving the versatility of a floor surface according to the events.

Also, the floor apparatus 1 described above comprises a passage surface 16 on one side corresponding to the seat surface 13 of the support base 8, and a second selective surface 15 on the other side which is bent by an angle of 90° relative to the passage surface 16 and corresponding to the first selective surface 14. The ratio of the rotating speed between the support bases 8 and the passage base 10 is set to be 2:1.

Thus, the floor apparatus 1 described above has a simple constitution and eliminates ineffective operations, and the second selective surface 15 on the passage base 10 can be made to correspond to the first selective surface 14.

Industrial Applicability

As described above, the floor apparatus according to the present invention is useful for appreciating events performed in theaters or other facilities, and is suitable for increasing or decreasing the number of seats depending upon the events.

I claim:

1. A floor apparatus comprising support bases on which seats are installed and a passage base arranged adjacent to said support bases, said bases being constituted to be rotatable about a first and second axes of rotation, respectively said support base having a seat surface on which the seats are installed and a first selective surface selectively used according to events, said passage base having a passage surface corresponding to the seat surface of the support base and a second selective surface corresponding to the first selective surface of the support base, and a rotating device for rotating said support base and passage base about the axes of rotation.

2. A floor apparatus according to claim 1, wherein the first selective surface is a surface arranged in the location opposing the seat surface, the support base is fixed to a shaft arranged along the axis of rotation, the second selective surface is a bent surface bent by 90° relative to the passage surface, the passage base is fixed on a support member arranged along the axis of rotation, a driving motor having an output shaft linked to the shaft of the support base and the support member of the passage base via a linkage mechanism is provided on the rotating device, and the ratio of the rotation speed between the support base and the passage base in the linkage mechanism is set to be 2:1.

* * * * *